US005732758A

United States Patent [19]

Marko

[11] Patent Number: 5,732,758

[45] Date of Patent: Mar. 31, 1998

[54] PIVOTING GARAGE DOOR SUPPORT

[76] Inventor: William R. Marko, 4261 Westroad Dr., West Palm Beach, Fla. 33407

[21] Appl. No.: 563,028

[22] Filed: Nov. 27, 1995

[51] Int. Cl.[6] ..... E05D 15/16

[52] U.S. Cl. ..... 160/201; 292/DIG. 36

[58] Field of Search ..... 160/201, 202, 160/222, 33, 35, 36, 37; 292/DIG. 36, 300, 36, 38

[56] References Cited

U.S. PATENT DOCUMENTS

| | | | |
|---|---|---|---|
| 884,011 | 4/1908 | Edman | 160/201 X |
| 3,424,223 | 1/1969 | Rosenblatt | 160/201 X |
| 3,838,877 | 10/1974 | Hanson | 292/DIG. 36 |
| 3,853,166 | 12/1974 | Wrono | 160/201 X |

*Primary Examiner*—Blair Johnson
*Attorney, Agent, or Firm*—McHale & Slavin

[57] ABSTRACT

A support assembly for doors, garage doors, or window shutters that cover building apertures. A support bar is mounted on a pivoting mount. Spring loaded locking assemblies are actuated by a lever assembly. With the locking assemblies retracted, the support can be pivoted from a horizontal passive position to a vertical engaged position. As the support assembly bar approaches the vertical position, the top lock assembly engages a top fixture and the bottom lock assembly engages a bottom fixture which are attached to the structure. External forces on the door or the shutter are transferred through the engaged support bar, through the fixtures, and to the building. The support bar mountably stays attached to the aperture cover, or door, in the passive position when the cover or door is opened.

8 Claims, 22 Drawing Sheets

71
75
76
27
68

21
23
30
28
29

208
68
67
24
21

52
34
33
21

36
27
75
204
10
68
20
200
202
23
24
28
29
206
84
33
67
21
33
27
37

67
27
37

PIVOTING GARAGE DOOR SUPPORT

BACKGROUND OF THE INVENTION

1. Field of the Invention

This invention relates, generally, to a reinforcing assembly for a garage door, and more specifically to such devices that provide support for garage door assemblies against wind loading.

2. Description of the Prior Art

It is well established that a large percentage of the population lives in the vast geographical region known as the "coastline." In fact, population estimates for the U.S. alone top fifty million. Repeated summer storms in this region affect not only the general safety of the population, but also the economy of the area. Exposure to severe weather often destroys building aperture covers. Often, the destruction of a building aperture cover rapidly leads to the failure of the entire building structure. Serious injuries and numerous deaths are common occurrences when an occupied building structure fails.

Typically, the most common building structure to fail under wind loads is the private home. The largest aperture cover in the typical home is the garage door. As the push for two-car garages continues, so does the installation of two-car garage door assemblies. The horizontal span for some of these garage doors can exceed sixteen feet. Because these doors are designed to "roll up" onto horizontal tracks when the door is opened, they are often constructed of lightweight materials. Commercially available doors are typically built with a "stile and skin" construction. The skin is typically sheet metal with a thickness of about twenty thousandths of an inch. This thickness is sufficient for average thunder storms, but not for hurricane force winds. When the garage door buckles under high wind loads, the garage is instantly pressurized. This often leads to a "domino" failure of the entire building structure. The instant pressurization of the garage causes the garage roof to be blown off the house. Once the garage roof blows off, the remaining roof blows off the house and the walls cave inward. Anyone occupying such a structure, as it fails in this manner, will most likely be severely injured or killed. Of course hurricanes do not affect just a single home. Rather, thousands of homes and businesses will be similarly affected resulting in losses in the billions of dollars.

The proper use of bracing during high wind loading can effectively prevent the collapse of wide span garage door. The resultant "domino effect" failure of the building structure can then be avoided. The support should be easy to engage by hand and without requiring the use of tools. To ensure frequent and timely use, the support should remain on the door in a passive position when not engaged. To avoid over-loading the horizontal door track when the door is opened, the support should not add significant weight to the door assembly. Finally, the support should be easily affordable so that every building owner will be inclined to buy and install a support on all garage doors and window shutters.

Support and latch assemblies for the attachment to garage doors are of course well known in the art. The prior art U.S. Pat. Nos. 3,708,917 to Streeter (1973), 3,815,943 to Hass (1974), 3,891,021 to Geoffrey (1975), 4,996,795 to Niswonger (1991), 5,205,096 to pace (1993), 5,331,786 to Lippert (1994), 5,337,520 to Uribe (1994), and 5,371,970 to Ganikon (1994) all relate to garage door supports and lock.

In the case of Streeter, Hass, Niswonger, and Ganikon, the inventions provide locking means for the garage door but no wind load support. Furthermore, these inventions do nothing for lowering the stresses on the door mount hardware.

In the case of Geoffrey, Pace, Lippert, and Uribe, the inventions provide structural support for the garage door but no wind load support. Furthermore, these inventions do nothing for lowering the stresses on the door mount hardware.

Another disadvantage of the prior art is the need for tools and some degree of expertise to install them. None of these devices were intended to be engaged by hand.

SUMMARY OF THE INVENTION

Although the invention has been described in terms of a specific embodiment with certain alternatives, it will be readily apparent to those skilled in this art that various modifications, rearrangements and substitutions can be made without departing from the spirit of the invention. The scope of the invention is defined by the claims appended hereto.

The garage door support of the present invention provides a support bar or beam which is pivotally mounted to the inner side of a garage door. The bar can be stowed horizontally, or can be pivoted into a vertical position and secured to fixtures mounted in the flooring and in the upper portion of the garage structure. A handle is provided which engages and disengages sliding latches or bolts which engage the fixtures. Yet another set of fixtures mounted on the garage door engages the bolts and securely holds the horizontally pivoted support bar in place against the garage door. The support bar is thereby stowed passively against the door and allows the garage door to be freely rolled up and down as needed.

Accordingly, several objects and advantages of my invention are:

(a) to provide a garage door support that buttresses the garage door against wind loads;

(b) to provide a garage door support that effectively halves the horizontal garage door span and provides a proportionate increase in wind load capability;

(c) to provide a garage door support that can be attached to a variety of different garage doors;

(d) to provide a garage door support that can be installed and removed from the door without permanently damaging the door;

(e) to provide a garage door support that remains on the door in a passive position when not in use;

(f) to provide a garage door support that can be hand-engaged by the homeowner;

(g) to provide a garage door support constructed of lightweight materials;

(h) to provide a garage door support constructed of inexpensive materials using inexpensive manufacturing techniques allowing for a very low retail price;

(i) to provide a garage door support whose attachment to the garage door is accomplished through a pivot mount;

Further objects and advantages of my invention will become apparent from a consideration of the drawings and ensuing description of a preferred embodiment.

DESCRIPTION OF THE PREFERRED EMBODIMENT

Figure 1:
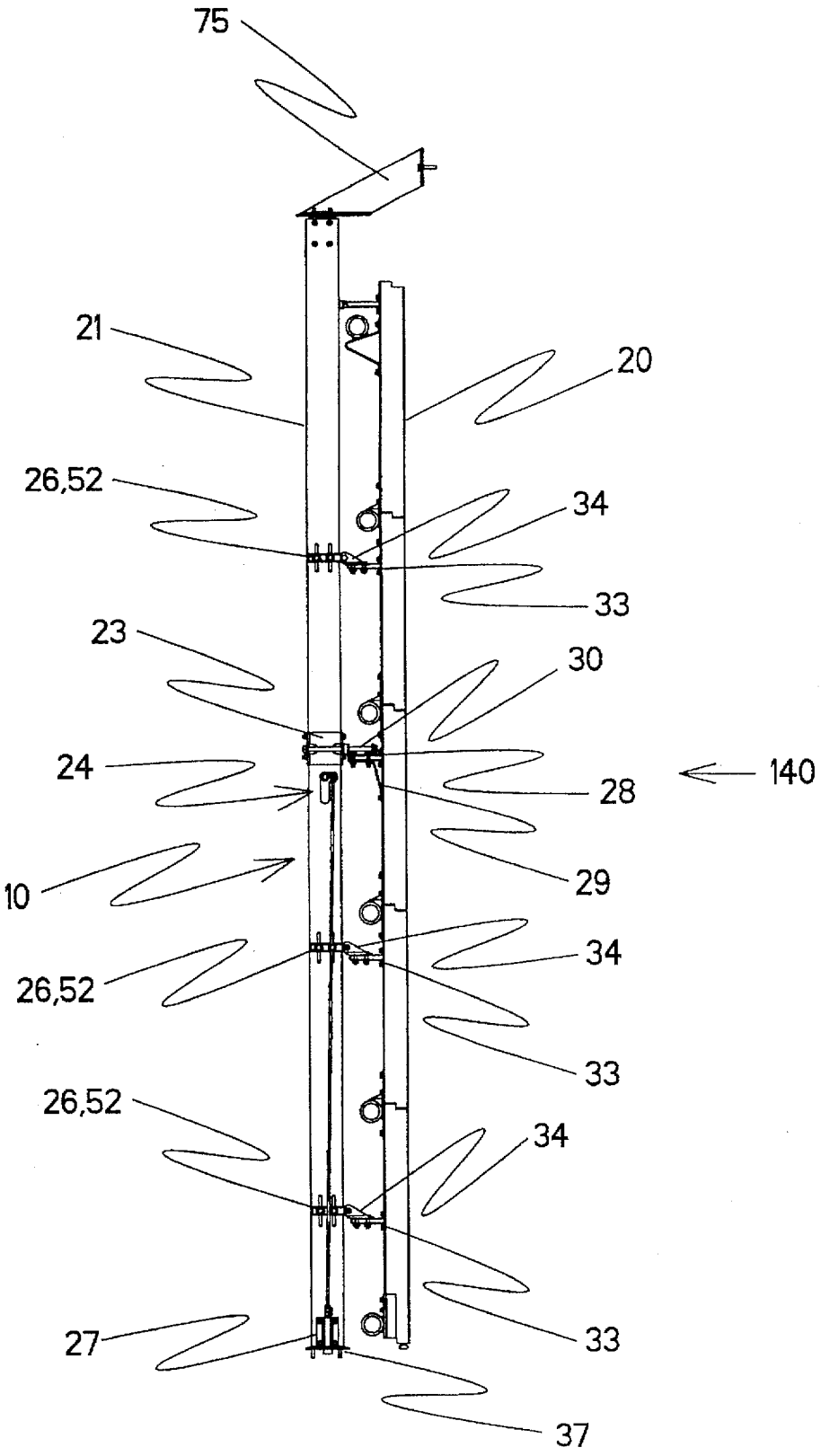
FIG. 1 is a side-elevational view of one embodiment of the garage door support assembly installed on an ordinary sectional garage door.

Referring now to FIG. 1, a side view is shown of the garage door support assembly 10. The garage door 20 is comprised of a plurality of door sections connected in a vertical plane. The door 20 additional includes a plurality of support braces 28, 33 which are mounted horizontally across the inner surface of the door. The support assembly 10 is comprised of a support bar 21 which is shaped in the form of a C-channel bar. A first support pivot assembly, or pivot mount 23, is used to connect the support bar to the garage door in a pivotal manner. A corresponding second pivot mount 29 is attached to a support brace 28. A pivot bolt 30 joins the first and second mounts 23 and 29 thereby connecting the bar 21 to the door 20 in a pivotal manner. A handle assembly 24 is used to control an upper and lower sliding lock assembly 27 which interact with an upper fixture 75 and lower fixtures 37 and serves to lock the support bar 21 in place. A plurality of pin mounts 52 and receiving apertures 34 are located along the support braces 33 to further secure the bar 21 in place.

Figures 1A, 1B, 1C, 1D, 1E, 1F:
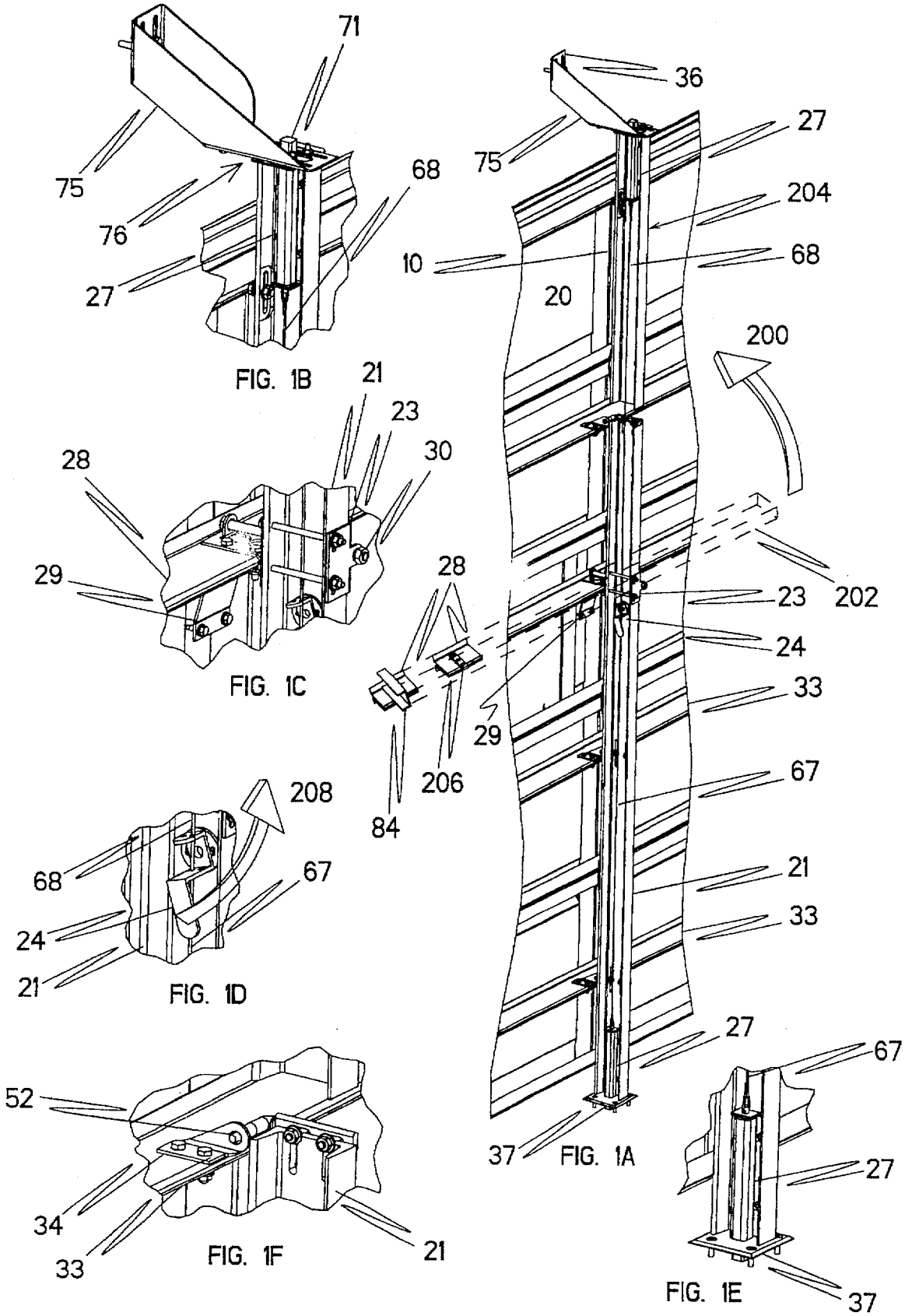
FIG. 1A is a perspective view of the garage door support assembly as fully mounted on a garage door and pivoted into its downward support position.
FIG. 1B is an enlarged top perspective view of the support bar of FIG. 1A lockably interacting with the upper fixture.
FIG. 1C is an enlarged perspective view of the pivot mount of FIG. 1A.
FIG. 1D is an enlarged perspective view of the pivoting latch handle of FIG. 1A.
FIG. 1E is an enlarged perspective view of the lower sliding latch of FIG. 1A.
FIG. 1F is an enlarged perspective view of a vertical safety pin mount of FIG. 1A.

Referring now to FIG. 1A–FIG. 1H a series of more detail views are shown which explain the operation of the disclosed support assembly 10. FIG. 1A shows a perspective view of a support assembly 10 as mounted on the inner surface of a garage door 20. The cross braces 28 and 33 are shown attached horizontally across the inner surface of the door 20. The first pivot mount 23 and second pivot mount 29 pivotally mount the bar 21 to the door 20. As shown by the arrow 200, the bar 21 is thereby free to rotate from a horizontal position 202 (shown in fathom) to a vertical position 204. The horizontal position 202 facilitates storage of the bar 21, while the vertical position 204 provides bracing support for the garage door 20. The handle assembly 24 is used to control sliding lock assemblies 27 via attached cables or rods 67, 68. The locks 27 interface with the upper fixture 75 and the lower fixture 37 to lock the bar 21 in its vertical support position. For storage purposes, the bar 21 is rotated to its horizontal position 202 and the same locks 27 are used to interface with a left bracing fixture 84 and a right bracing fixture 88 (not shown in this view). A horizontal aperture 208 is attached to the cross brace 28. This aperture 208 interfaces with the pin mount assembly 52 and further supports the bar 21 in is horizontal storage position.

Referring now to FIG. 1B, an enlarged view of the upper fixture 75 is shown from FIG. 1A. The sliding lock 27, as slidably controlled by the cable or rod 68, includes an angled bar 71 which penetrates an aperture in the fixture 75. The edge of the mounting plate 76 is shown which is used to mount the fixture 75 to the bar 21. The upper fixture 75 and its associated hardware is detailed further in FIG. 14.

Referring now to FIG. 1C, an enlarged view of the first and second pivot mounts 23 and 29 are shown from FIG. 1A. Mount 23 attaches the bar 21, and mount 29 attaches to the cross brace 28. The bolt 30 is used to pivotally connect the two mounts together. The first and second pivot mounts 23 and 29 are their associated hardware are detailed further in FIGS. 3–5.

Referring now to FIG. 1D, an enlarged view of the handle assembly 24 is shown as mounted to the bar 21. A cable or rod 67, 68 is shown to run through the handle assembly 24. When the handle assembly 24 is pivoted as shown by arrow 208, the upper cable or rod portion 68 and the lower cable or rod portion 67 are pulled to cause sliding movement of the upper and lower lock assemblies 27. Another embodiment of the pivoting handle assembly is detailed further in FIG. 12.

Referring now to FIG. 1E, an enlarged view of the sliding lock assembly 27 of FIG. 1A is shown. The lock assembly 27 is slidably controlled by the attached cable or rod 67 which is pulled by the handle assembly 24. The latch assembly interacts with lower fixture 37. The lock assembly 27 is further detailed in FIG. 13, and the lower fixture is further detailed in FIG. 15.

Referring now to FIG. 1F, an enlarged view of a safety pin 52 and aperture assembly 34 are shown. The aperture assembly 34 mounts on the cross brace 33, while the pin 52 mounts on the bar 21. The pin 52 is then guided to penetrate the aperture assembly 34 to provide further support of the garage door 20 against the bar 21. Referring again to FIG. 1A, the pin 52 would be guided to penetrate the horizontally mounted aperture 206 when the bar 21 is stowed in the horizontal position 202.

Figures 1G, 1H:
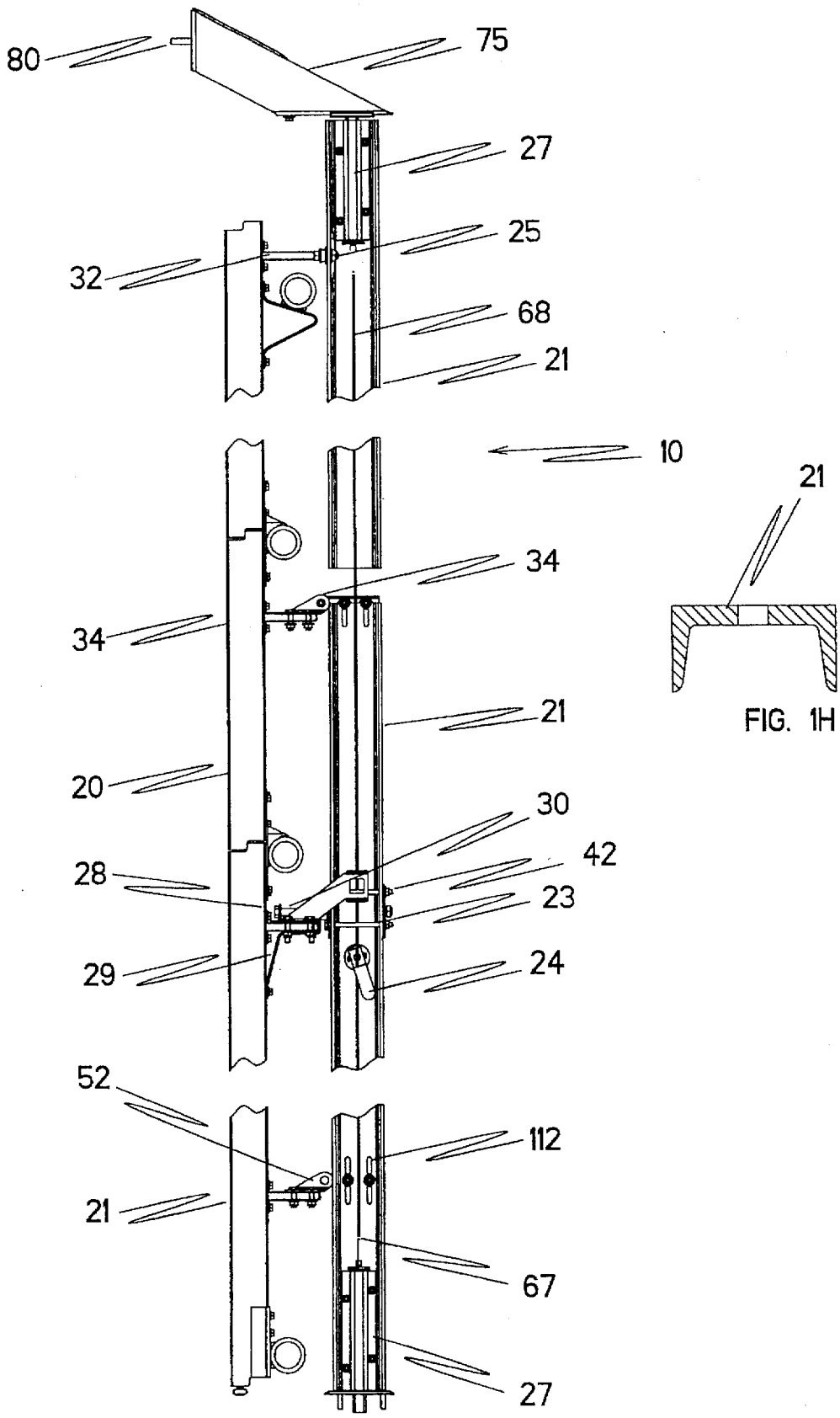
FIG. 1G is a side view of the garage door support assembly as mounted on a garage door and with the support bar in its vertical support position.
FIG. 1H is a cross-section view of the support bar of FIG. 1G along cut M—M.

Referring now to FIG. 1G, a more detailed side view of the garage door 20 and support assembly 10 are shown. The second pivot mount 29 is mounted to the cross brace 28 and the first pivot mount 23 is pivotally connected via bolt 39. First pivot mount 23 is connected to the bar 21 via bolts 42. The upper sliding lock 27 interacts with the upper fixture 75, and the fixture 75 is attached to the garage structure via a plurality of screws 80. The handle assembly 24 interacts with the upper and lower cables or rods 68, 67 providing sliding movement of the lock assemblies 27. The safety pins 52 and pin aperture assemblies 34 are more clearly shown. The aperture assemblies 34 are attached to the lower cross braces 33. The pins 52 are adjustably mounted to the bar 21 via the elongated through holes 112. The pin assembly is further detailed in FIG. 9. The aperture assembly is further detailed in FIG. 10. The pin and aperture assembly together are further detailed in FIGS. 1M, and FIG. 8. Additionally, an upper cross brace 32 butts against an adjustable support or contact post assembly 25, as further detailed in FIG. 6. FIG. 1H shows a cross-sectional view of the bar or brace 21 along cut M—M. This shows the C-shaped beam structure of the bar 21.

Figure 1J:
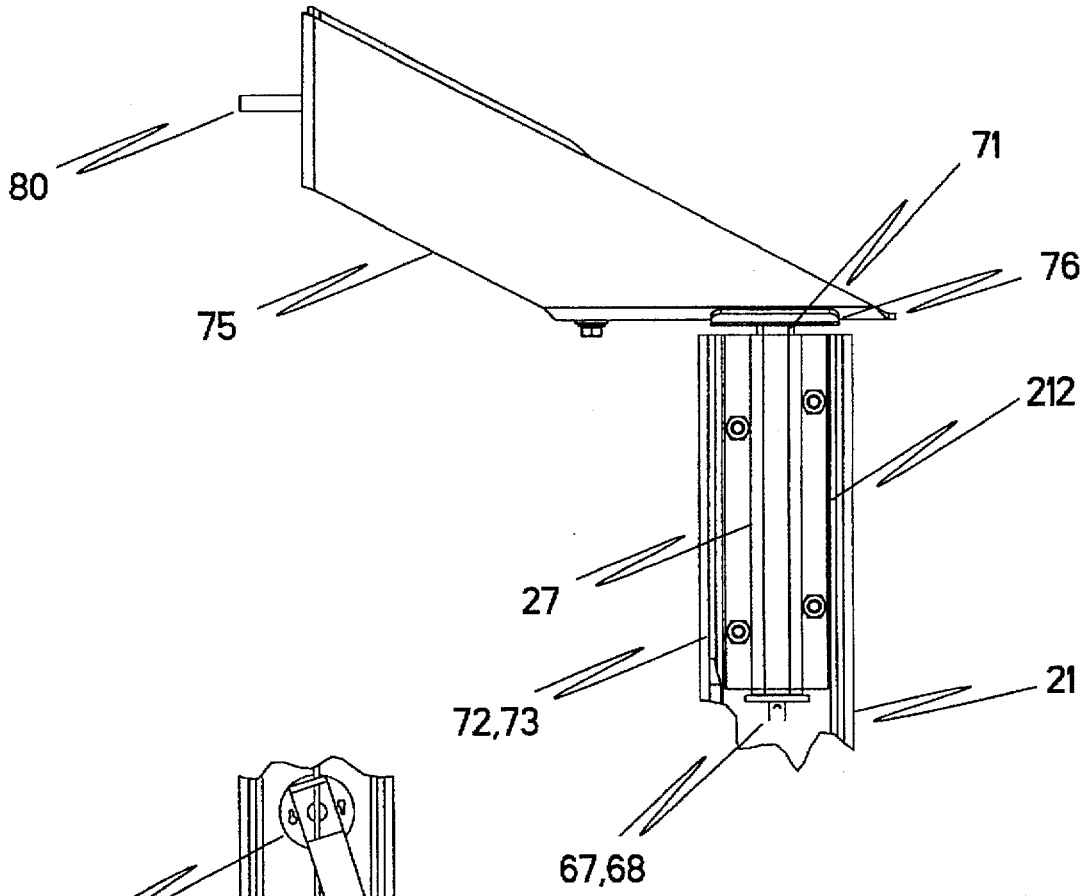
FIG. 1J is a side view of the latch handle of the garage door support assembly.
Figure 1J:
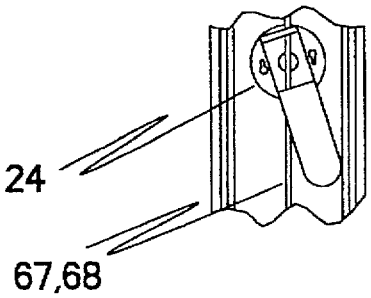
Figure 1K:
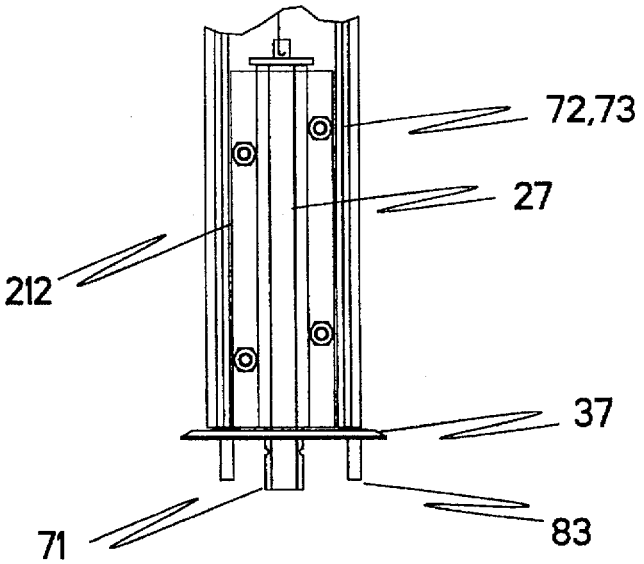
FIG. 1K is a side view of the upper and lower sliding latches and latching fixtures of the garage door support assembly.
Figure 1L:
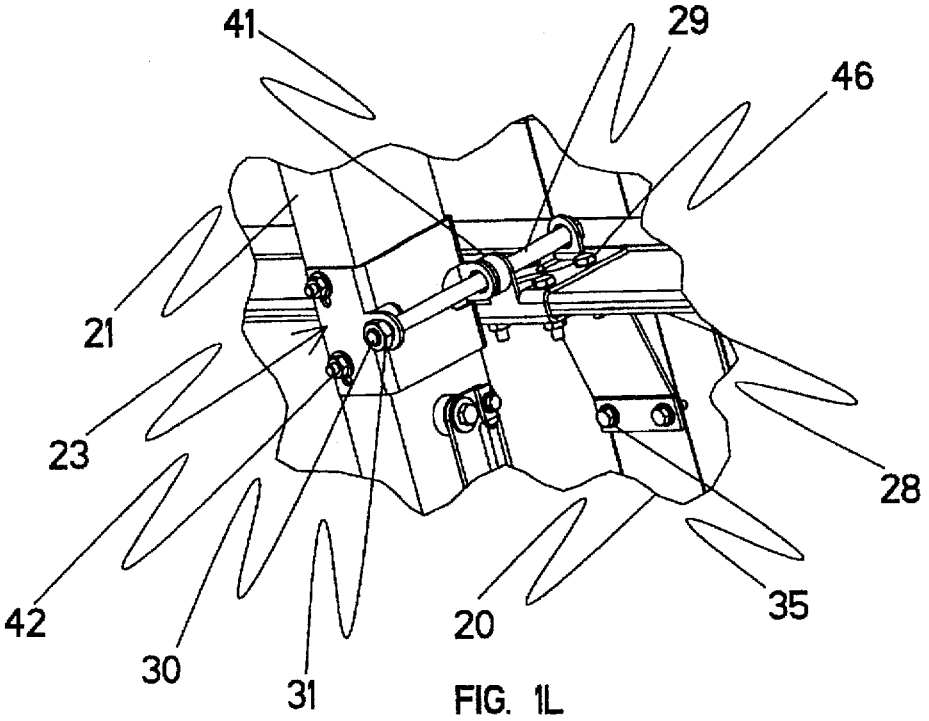
FIG. 1L is an enlarged perspective view of an embodiment of the pivot mount of the garage door support assembly.

Referring now to FIG. 1L, a detailed view of an embodiment of the first and second pivot mounts 23 and 29 are shown. The embodiment shows an enclosed structure around the joining bolt 30 in both the first and second mounts 23, 29. The embodiment shown in FIGS. 3–5 have an open structure wherein the bolt is exposed. The present invention is intended to encompass either such structure. The first mount 23 is attached to the bar 21 via bolts 42. The second mount 29 is attached to cross brace 28 via bolts 46, and is also attached to the garage door surface via bolts 35. Any number of spacers 41 can be used between the parts as necessary for proper positioning of the bar 21 relative to the door 20. A long bolt 30 is threaded through both mounts 23 and 29 and secured with bolt 31 to provide pivotal mounting of the bar 21 relative to the door 20.

Figure 1M:
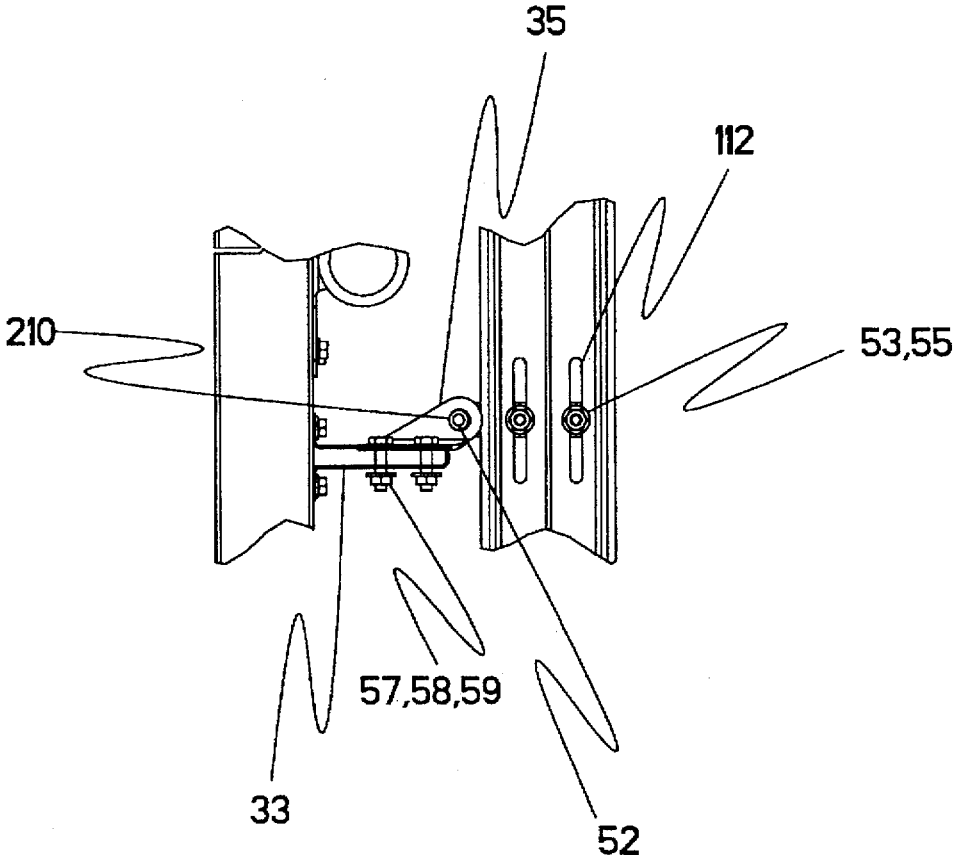
FIG. 1M is a side view of the safety pin mount of the garage door support assembly.

Referring now to FIG. 1M, a detailed view of the mounted pin 52 and aperture assembly 34 are shown. The pin 52 includes a pair of nuts and bolts 53, 55 for mounting the pin 52 through a pair of elongated slots 112. The slots 112 allow adjustment and positioning of the pin 52 relative to the aperture assembly 34 and the aperture assembly hole 210. The aperture assembly 34 is mounted to cross brace 33 via nut and bolt assemblies 57, 58, 59.

Referring now to FIG. 1J and 1K, a detailed view of the pivoting handle assembly 24 and the associated sliding lock assemblies 27 are shown. FIG. 1J shows the handle assembly 24 with the cables or rods 67, 68 penetrating holes in the handle. When the handle assembly is turned, the cable or rod is twisted and pulled from both directions to cause sliding movement of both the upper and lower latching assemblies 27. The locking assemblies 27 include an outer bracket 212 which is mounted to the bar 21 via bolt and nut combinations 72, 73. The bolt 71 slides inside the bracket 212 and penetrates apertures in the upper fixture 75 and the lower fixture 37. The upper fixture 75 is secured to the garage structure via bolts or screws 80 and the lower fixture 37 is secured to the flooring or base structure via bolts or screws 83.

Figure 2:
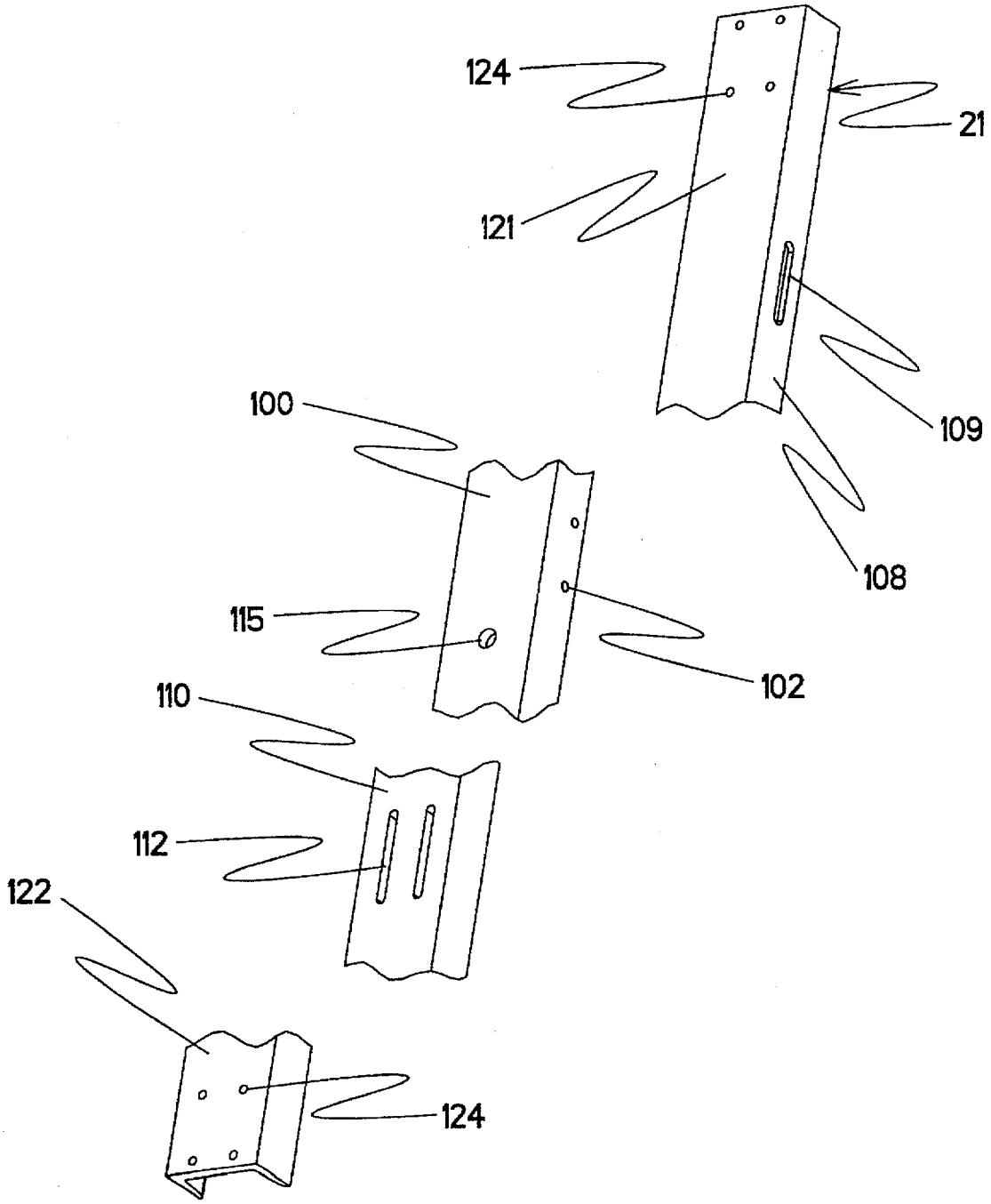
FIG. 2 is a perspective view of the support C-channel of FIG. 1.

Referring now to FIG. 2, mounting apertures and holes of the support bar 21 are shown. Through holes 124 are located on the upper front surface 121, and the lower front surface 122, of the bar 21 for mounting the brackets 212 of the locking assemblies 27. The aperture 109 is located through the side surface 108 and is used for mounting the contact post assembly 25 which abuts against the upper cross brace 32 (See FIG. 1G). The upper middle portion 100 of the bar 21 includes through holes 102 in the side surface 108 for mounting the first pivot mount 23. Through hole 115 is used to mount the handle assembly 24. The lower middle portion 110 of the bar 21 includes elongates slots 112 for mounting the pin assembly 52.

Figure 3:
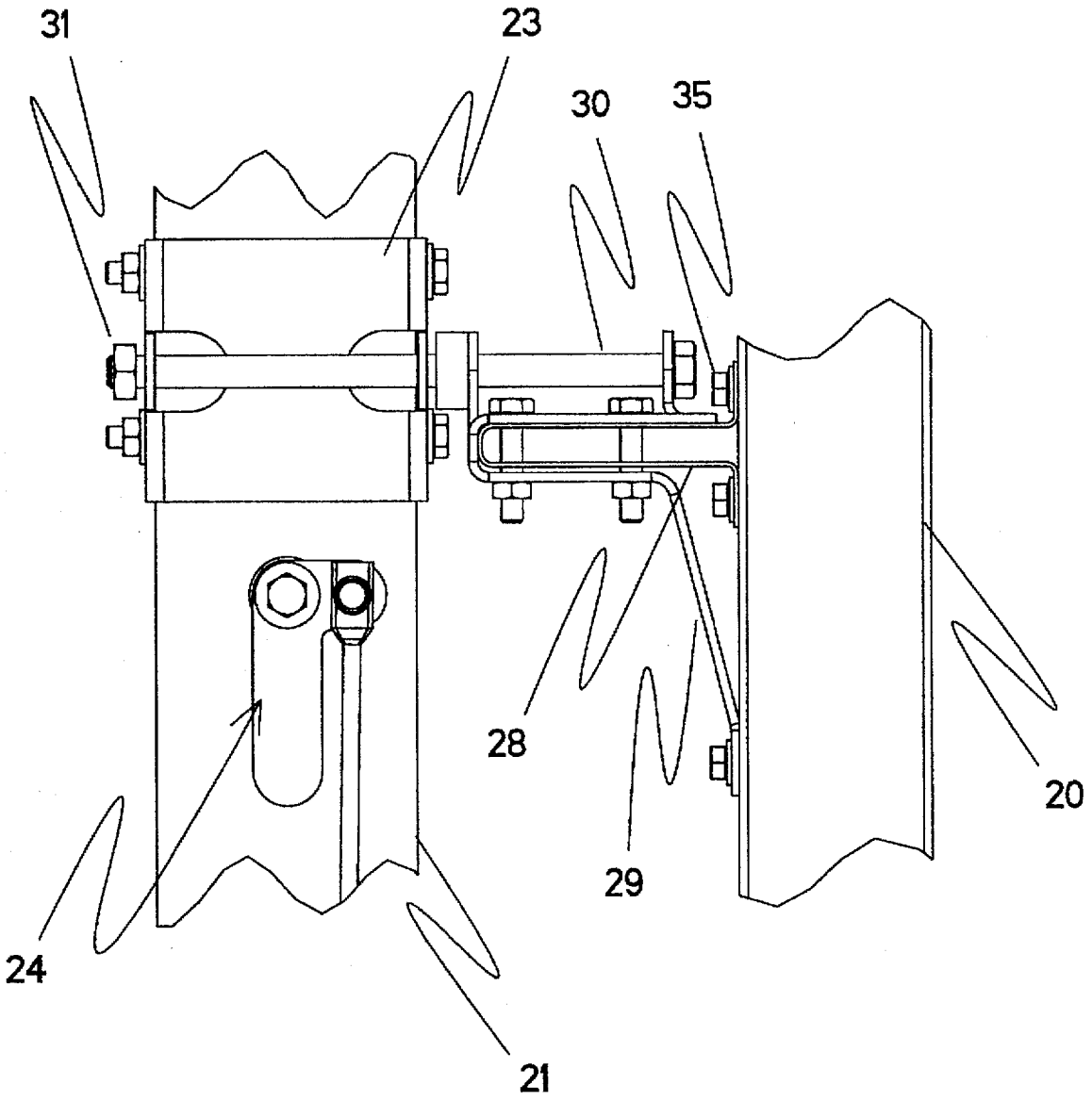
FIG. 3 is a side-elevational view, proportionally enlarged, of a pivoting mechanism and a release lever assembly employable on the support assembly of FIG. 1.

Referring now to FIG. 3, the first and second pivot mounts 23 and 29 are shown mounted and pivotally interconnected in their respective positions. Cross brace 28 is shown to extend from the inner surface of the garage door 20. The second mount 29 is attached to the door 20 via bolts or screws 35. The bolt 30 extends through the first and second mounts 23, 29 and is secured with the bolt 31. A side view of another embodiment of the handle assembly 24 is shown. This handle assembly 24 is further detailed in FIG. 12.

Figure 4:
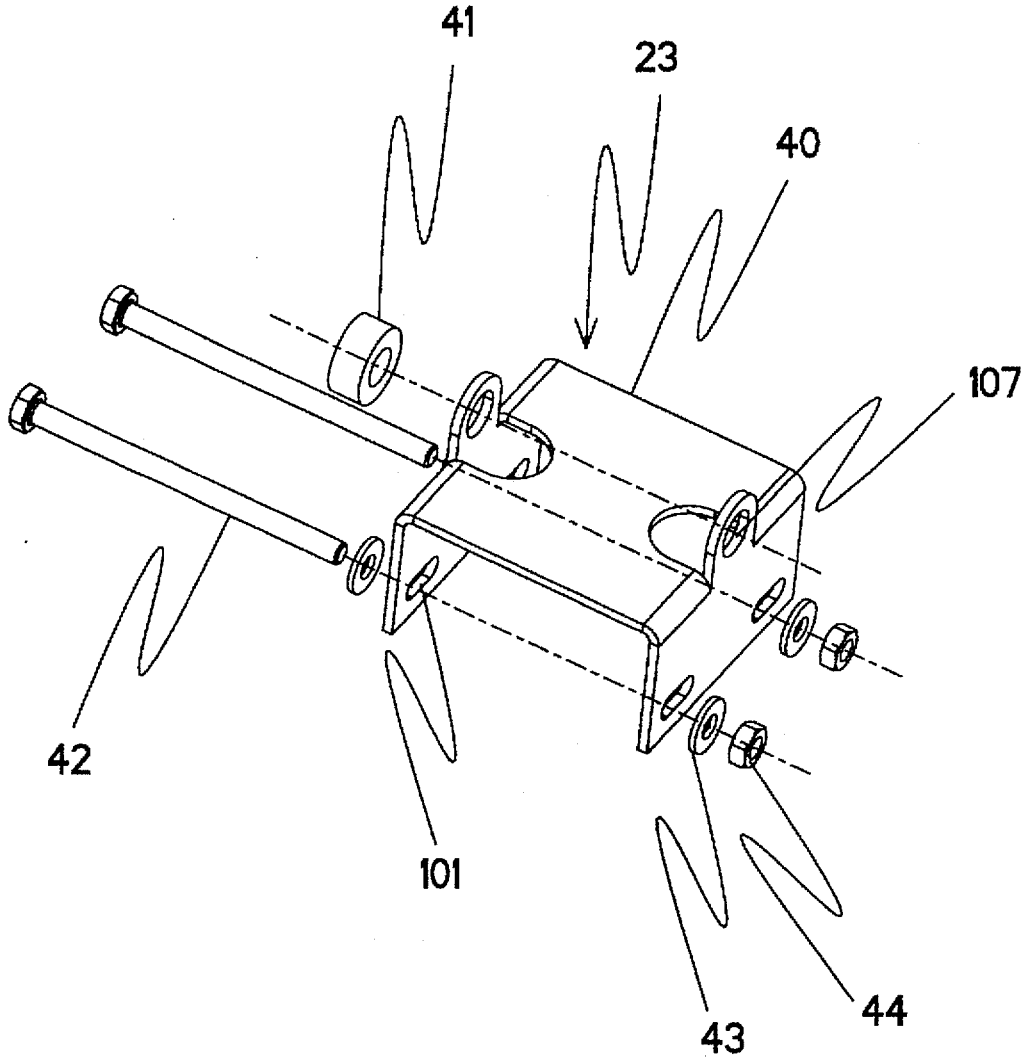
FIG. 4 is an exploded perspective view of the support pivot assembly of FIG. 2.

Referring also now to FIG. 4, the first pivot mount assembly 23 is shown. The assembly includes a central U-shaped bracket 40 which is bent to form a pair of apertures 107 across the upper surface. The side surfaces of the bracket 40 fit around the bar 21 and the elongated apertures 101 align with the holes 102 on the bar 21. A pair of bolts 42 penetrates the apertures 101 and holes 102 and the washer/nut combination 43, 44 secures the bracket 40 to the bar 21. A spacer 41 is additionally shown aligned with the aperture holes 107.

Figure 5:
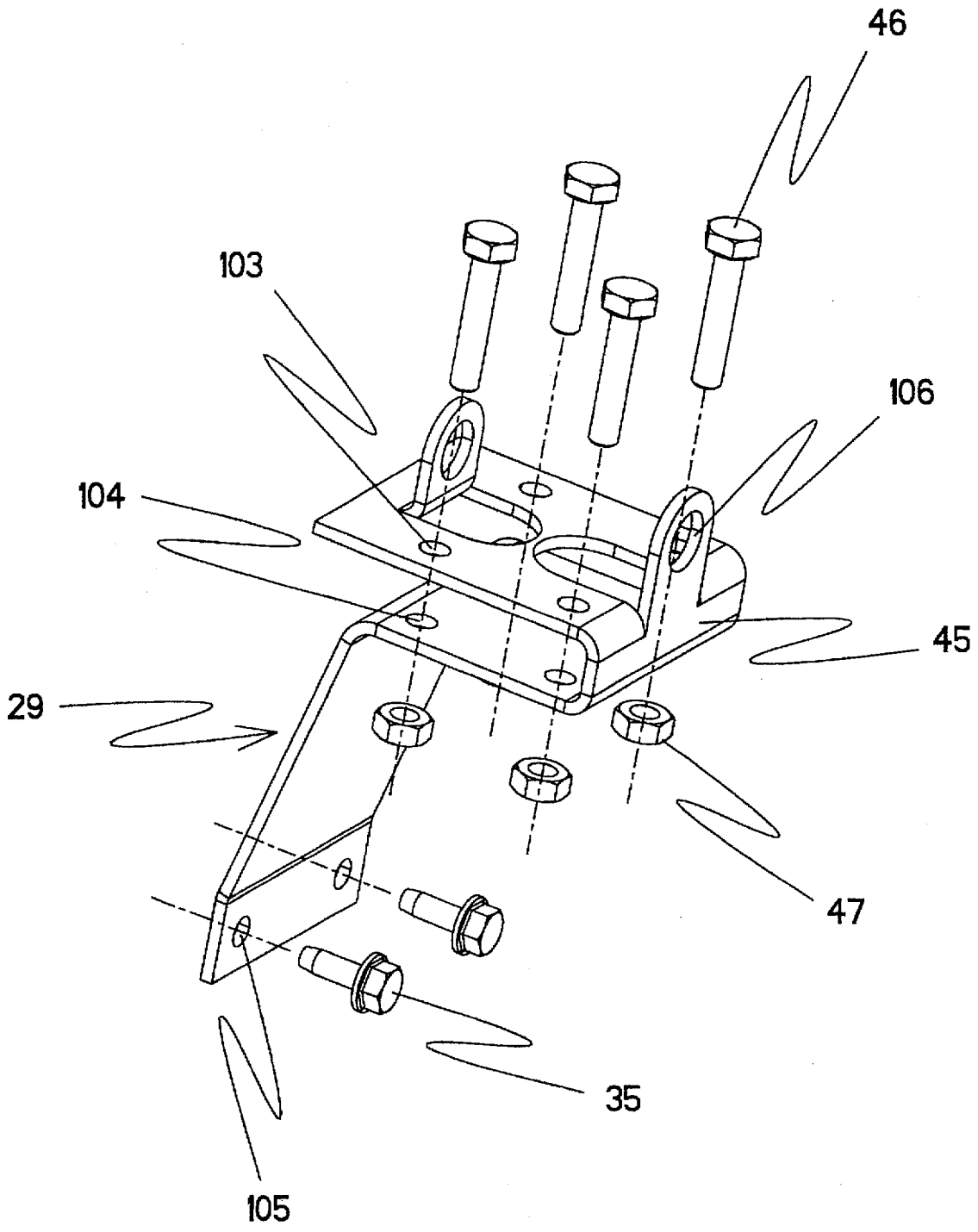
FIG. 5 is an exploded perspective view of the door pivot assembly of FIG. 2.

Referring also to FIG. 5, the second pivot mount assembly 29 is shown. The assembly includes a bracket 45 which fits over the support brace 28. The bracket 45 is secured via securing bolts 46 extending through holes 103 and 104, with the bolts secured by nuts 47. The upper portion of the bracket 45 is bent to form apertures 106 which align with apertures 107 of bracket 40. The lower portion of the bracket 45 is secured to the garage door via bolts or screws 35 through holes 105.

Figure 6:
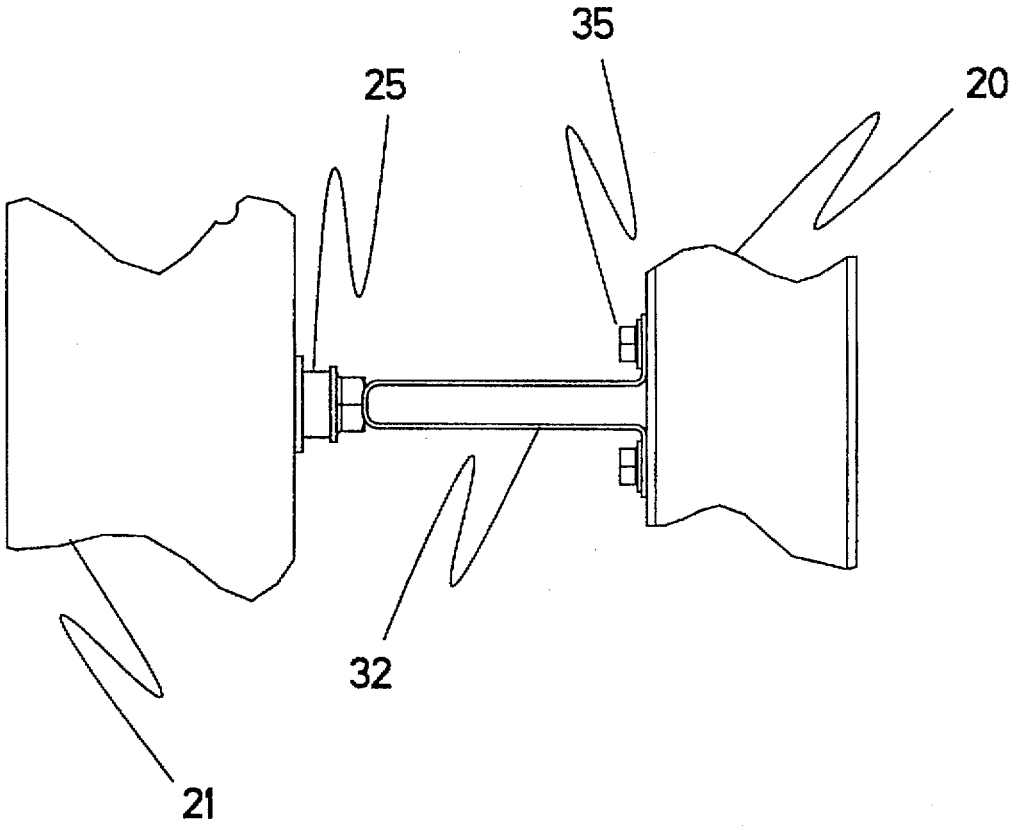
FIG. 6 is a side-elevational view, proportionally enlarged, of a contact assembly employable on the support assembly of FIG. 1.
Figure 7:
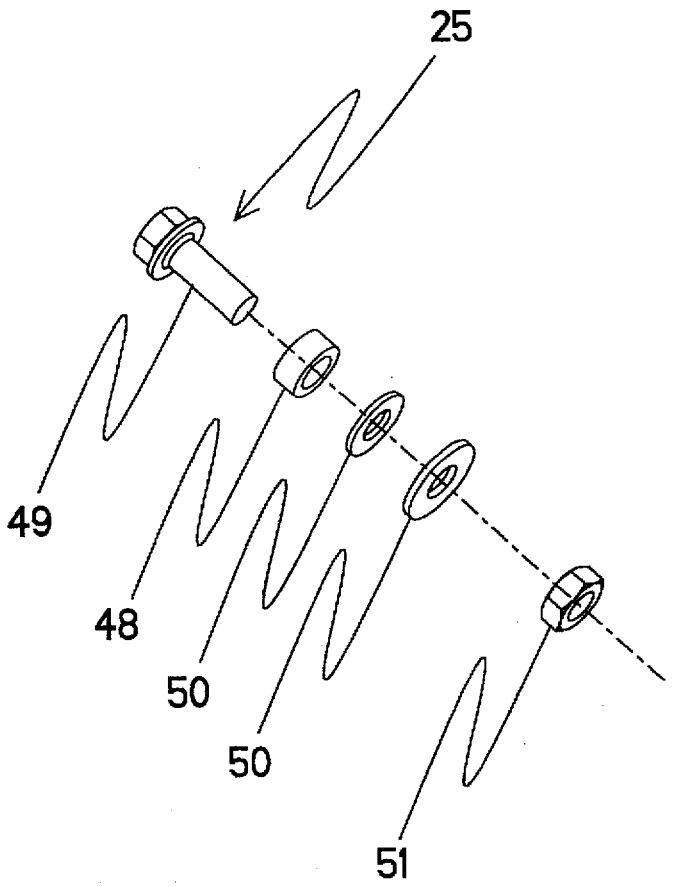
FIG. 7 is an exploded perspective view of the contact post assembly of FIG. 6.

Referring now to FIGS. 6 and 7, the upper cross brace 32 is shown attached to the garage door 20 via bolts or screws 35. The contact post assembly 25 is mounted directly opposite in the slot 109 of the bar 21. FIG. 7 shows the spacer assembly components which include a bolt 49, a spacer 48, a pair of washers 50 and a bolt 51. The slot 109 allows the contact post assembly 25 to be adjusted up and down to abut against the upper cross brace 32.

Figure 8:
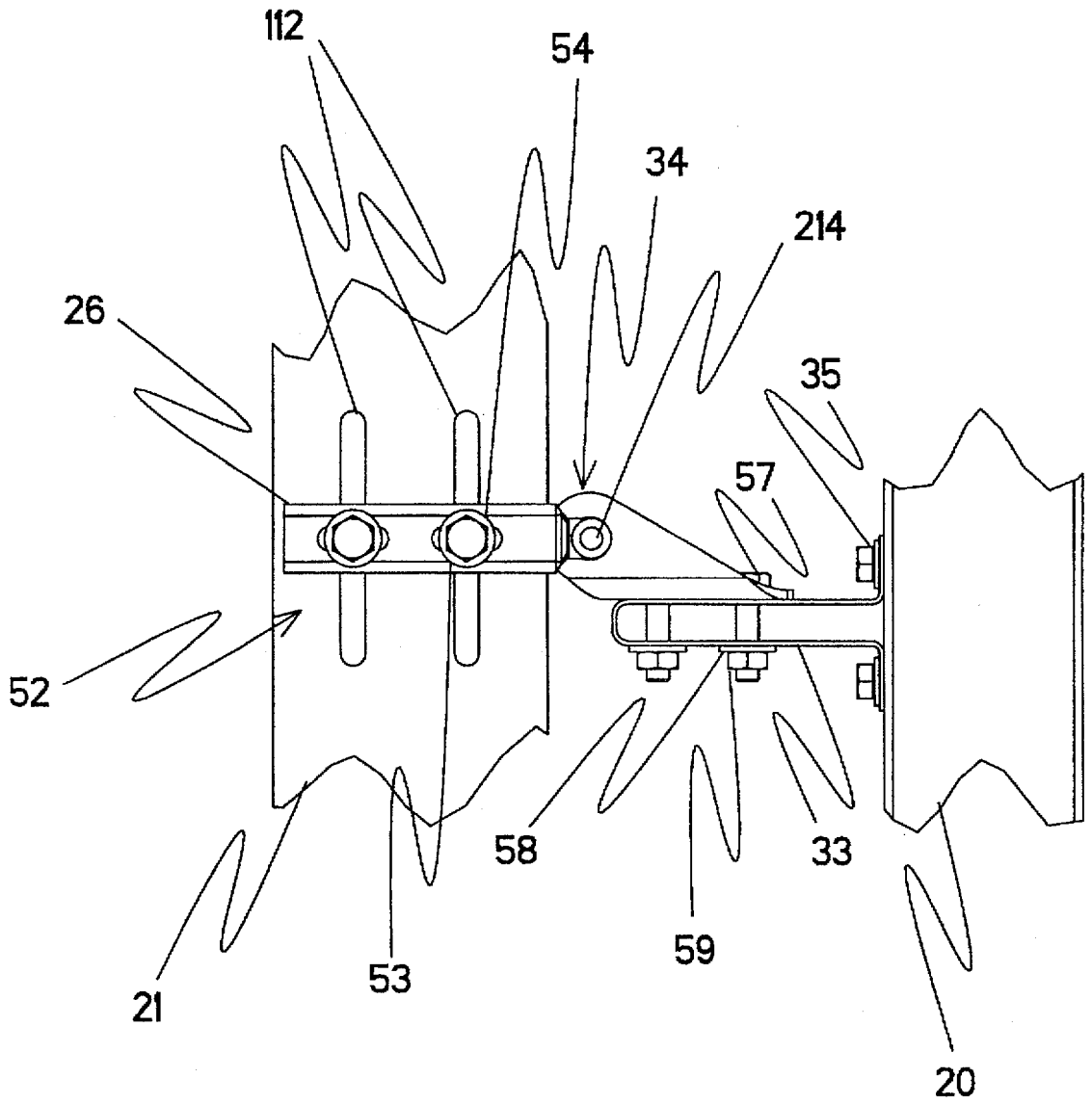
FIG. 8 is a side-elevational view, proportionally enlarged, of a catch assembly employable on the support assembly of FIG. 1.
Figure 9:
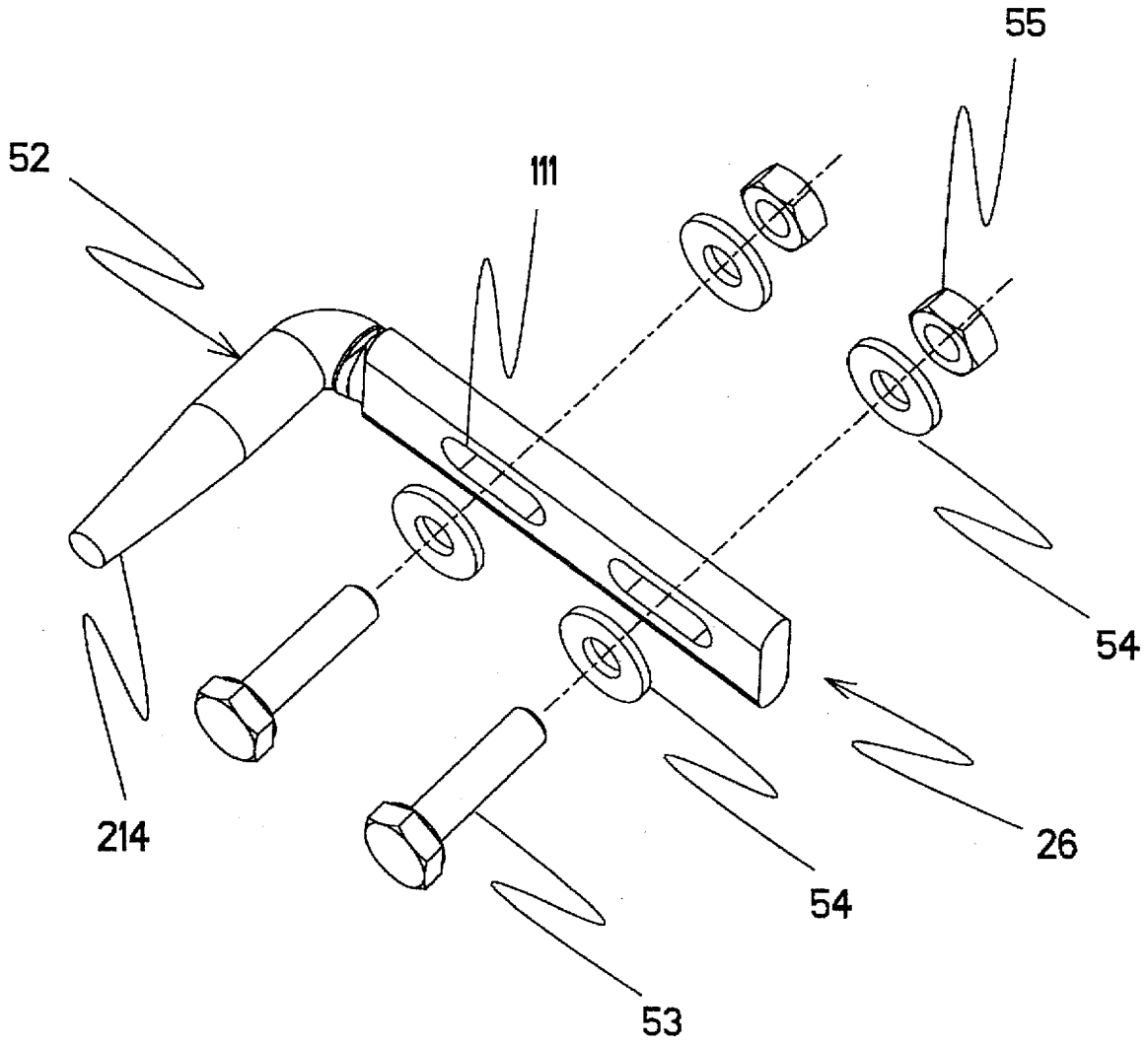
FIG. 9 is an exploded perspective view of the support catch assembly of FIG. 8.
Figure 10:
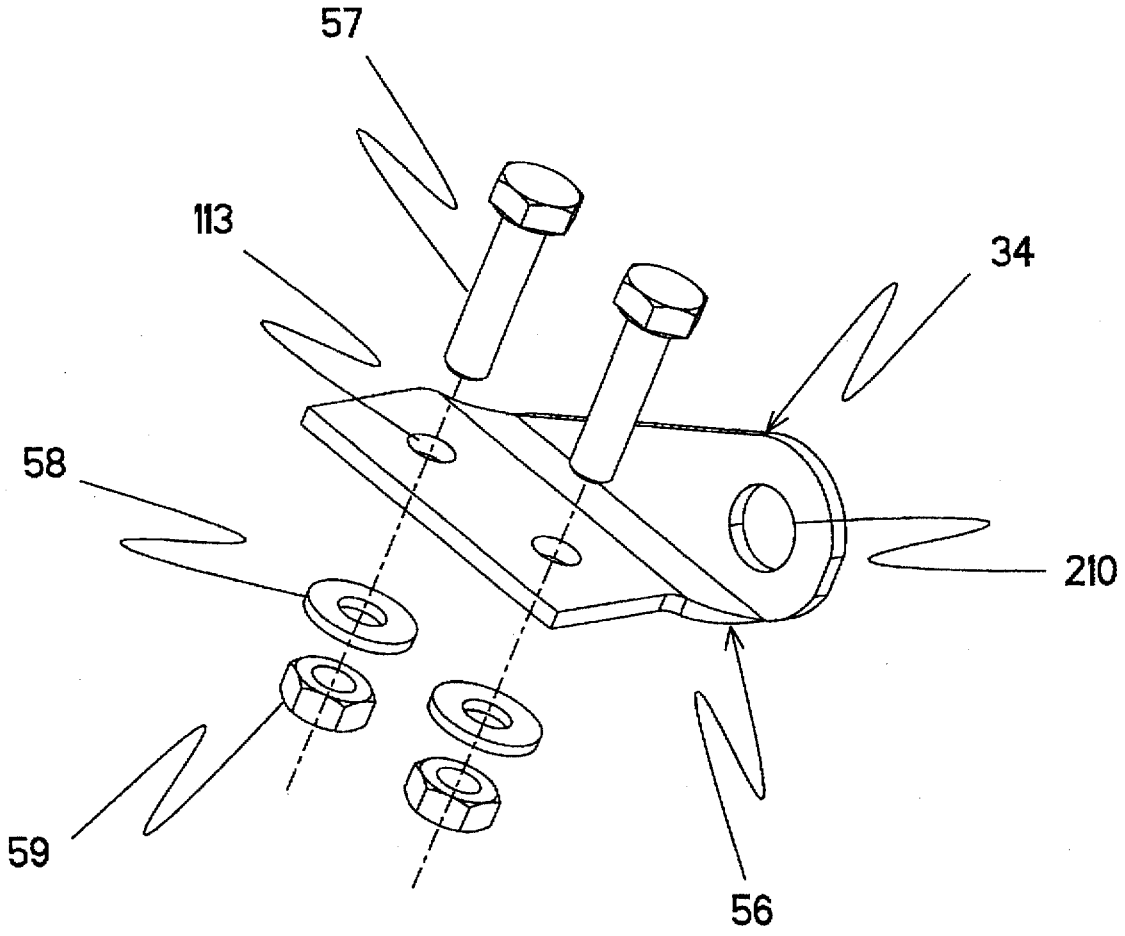
FIG. 10 is an exploded perspective view of the door catch assembly of FIG. 8.

Referring now to FIGS. 8, 9, and 10 the safety pin assembly 52 and pin mounting aperture 34 are shown. FIG. 8 shows a cross brace 33 mounted to the garage door 20 via bolts or screws 35. The pin mounting aperture 34 is shown mounted to the cross brace 33. The mounting bar 26 of the pin assembly 52 is correspondingly mounted on the bar 21 via bolts extending through the elongated slots 112. The slots 112 allow the pin assembly 52 to be adjusted up and down so that the pin 214 penetrates the aperture hole 210. FIG. 9 additionally shows the pin assembly 52 with the mounting bar 26 having elongated mounting holes 111. Bolt assemblies 53, 54, and 55 extend through the holes 111 and through the slots 112 to provide additionally adjustable side to side mounting of the pin assemblies 52. FIG. 10 shows the aperture assemblies 34 with through holes 113 which receive mounting bolt assemblies 57, 58; and 59.

Figure 11:
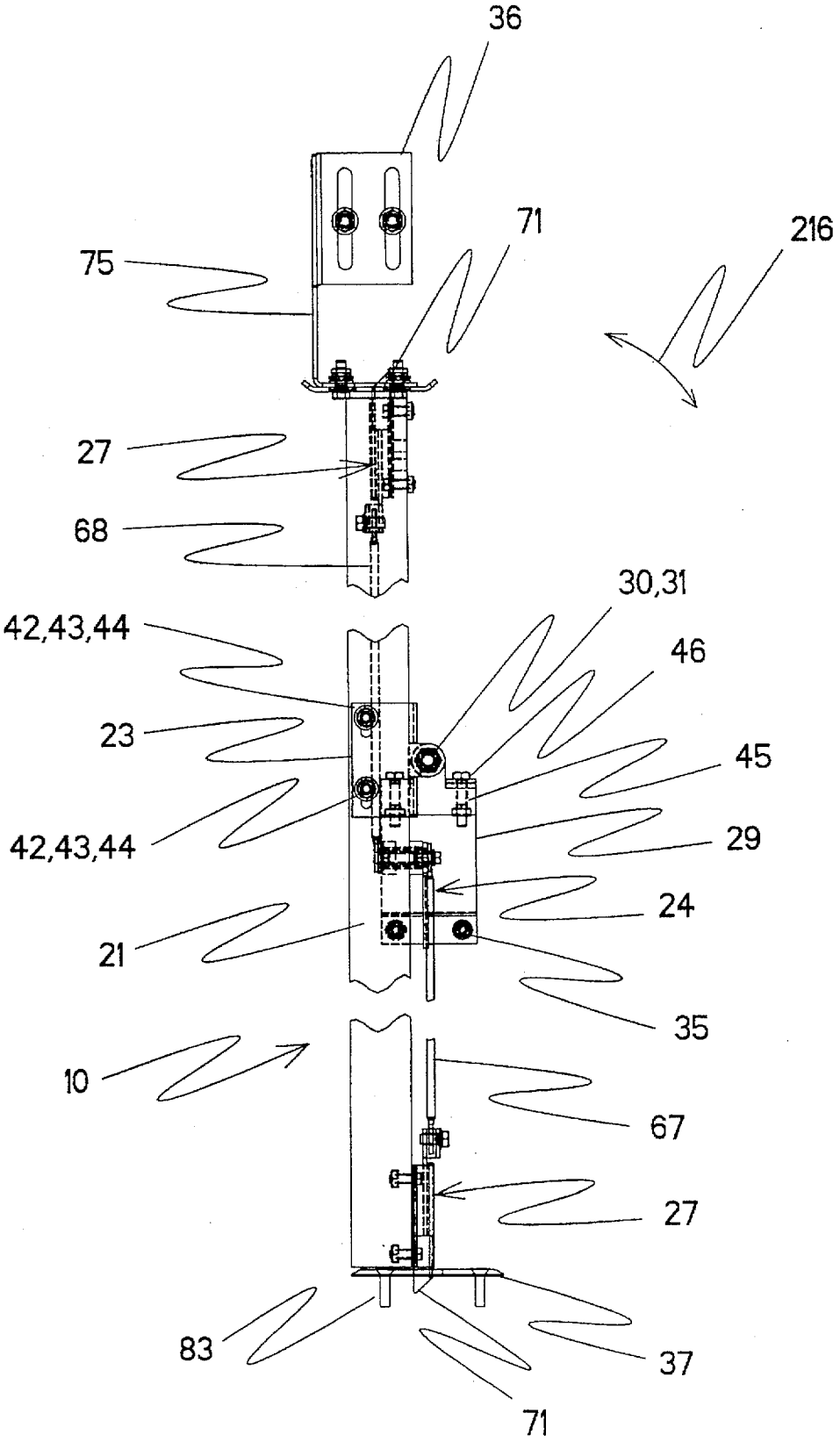
FIG. 11 is an inside-elevational view of the support assembly of FIG. 1, in the vertical position.
Figure 16:
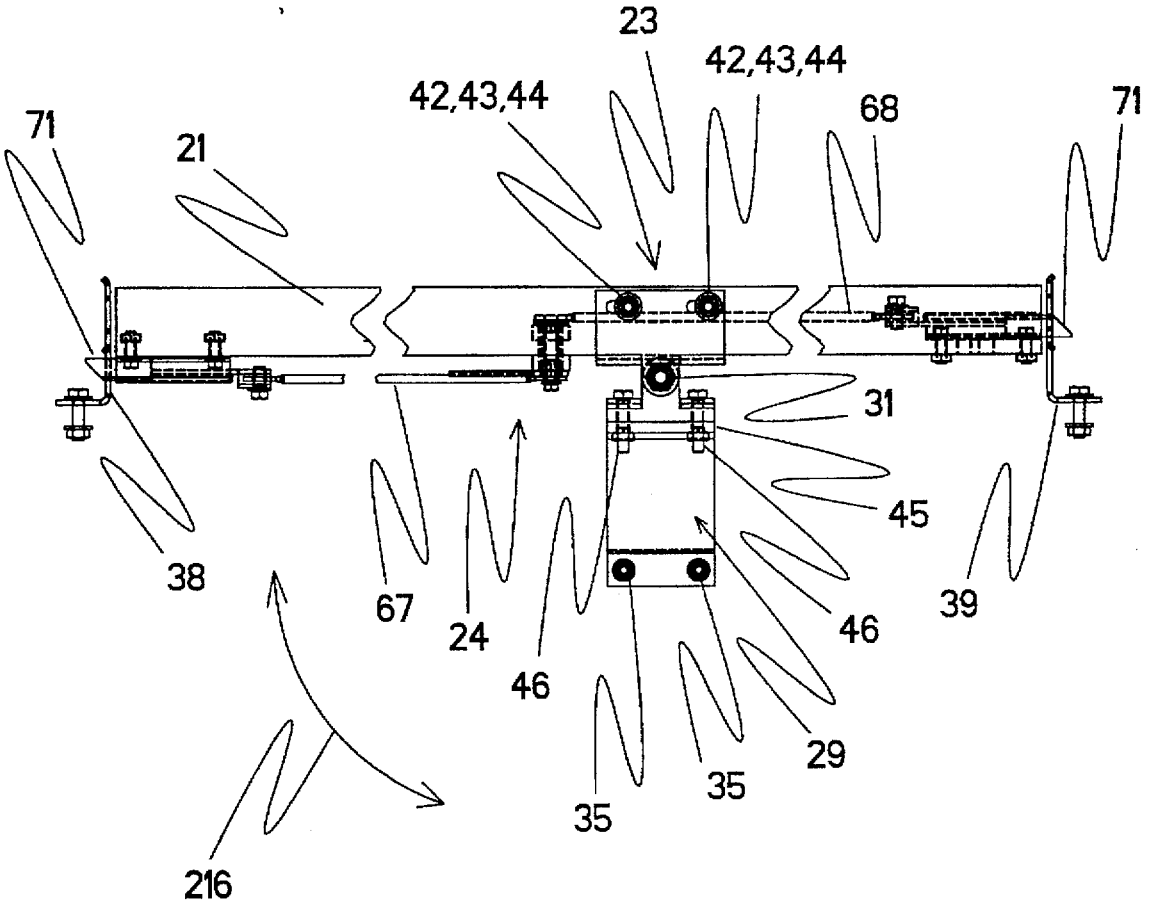
FIG. 16 is an inside-elevational view of the support assembly of FIG. 1, in the horizontal position, with connecting hardware shown.

Referring now to FIGS. 11 and 16 together, a front view of the garage door support assembly 10 is shown. The bar 21 rotates about the pivot mounts 23 and 29 as shown by the arrow 216. The first pivot mount 23 is mounted to the bar 21 via bolt assemblies 42, 43, and 44. The second pivot mount 29 is attached to the cross brace via bolts 46 and to the garage door via screws 35. The first and second pivots mounts 23 and 29 thereby pivot about the bolt and nut assembly 30, 31. The handle assembly 24 is additionally shown which slidably controls the lock assemblies 27 via the cables or rods 67, 68. In FIG. 11, the bar 21 is shown in the vertical position. The upper latch bolt 71 penetrates the upper fixture 75 which is attached to the garage structure via surface 36. The lower latch bolt 71 penetrates the lower fixture 37 which is attached to the floor via bolts 83. In FIG. 16, a similar front view is shown, but with the bar 21 rotated to a horizontal storage position as shown by arrow 216. The left bracket assembly 38 receives the lower latch bolt 71, and the right bracket assembly 39 receives the upper latch bolt 71, as slidably controlled via the handle assembly 24.

Figure 12:
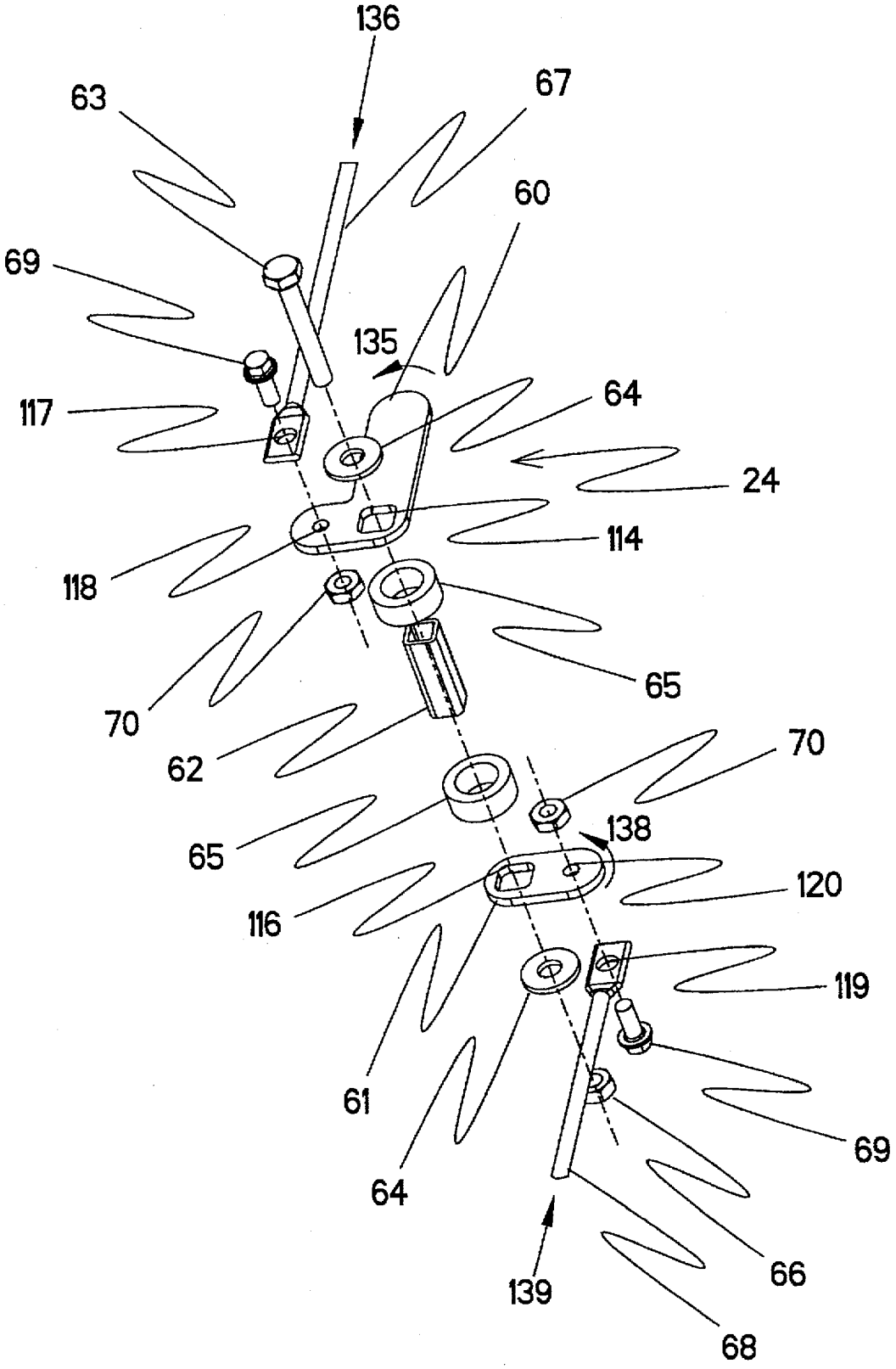
FIG. 12 is an exploded perspective view of the release lever assembly of FIG. 11.

Referring now to FIG. 12, an exploded view of the handle assembly 24 is shown. The handle assembly includes an outboard release lever 60 which has a squarish hole 114 for receiving a key 62 which similarly fits through a hole 116 in an inboard release lever 61. The levers are connected on opposites sides of the bar 21 via the bolt 63, washers 64, spacers 65 and nut 66. The first cable or rod extension 67 is connected to the lever hole 118 via the flattened section 117 and bolt/nut combination 69, 70. The second cable or rod extension 68 is connected to the lever hole 120 via flattened section 119 and bolt/nut combination 69, 70. When the lever 60 is pivoted as shown by arrow 135, the cables or rods are pulled inward as shown by arrows 136 and 139. This causes the slidable lock assemblies 27 to move inward thereby freeing the bar to pivot about its mounts 23, 29.

Figure 13:
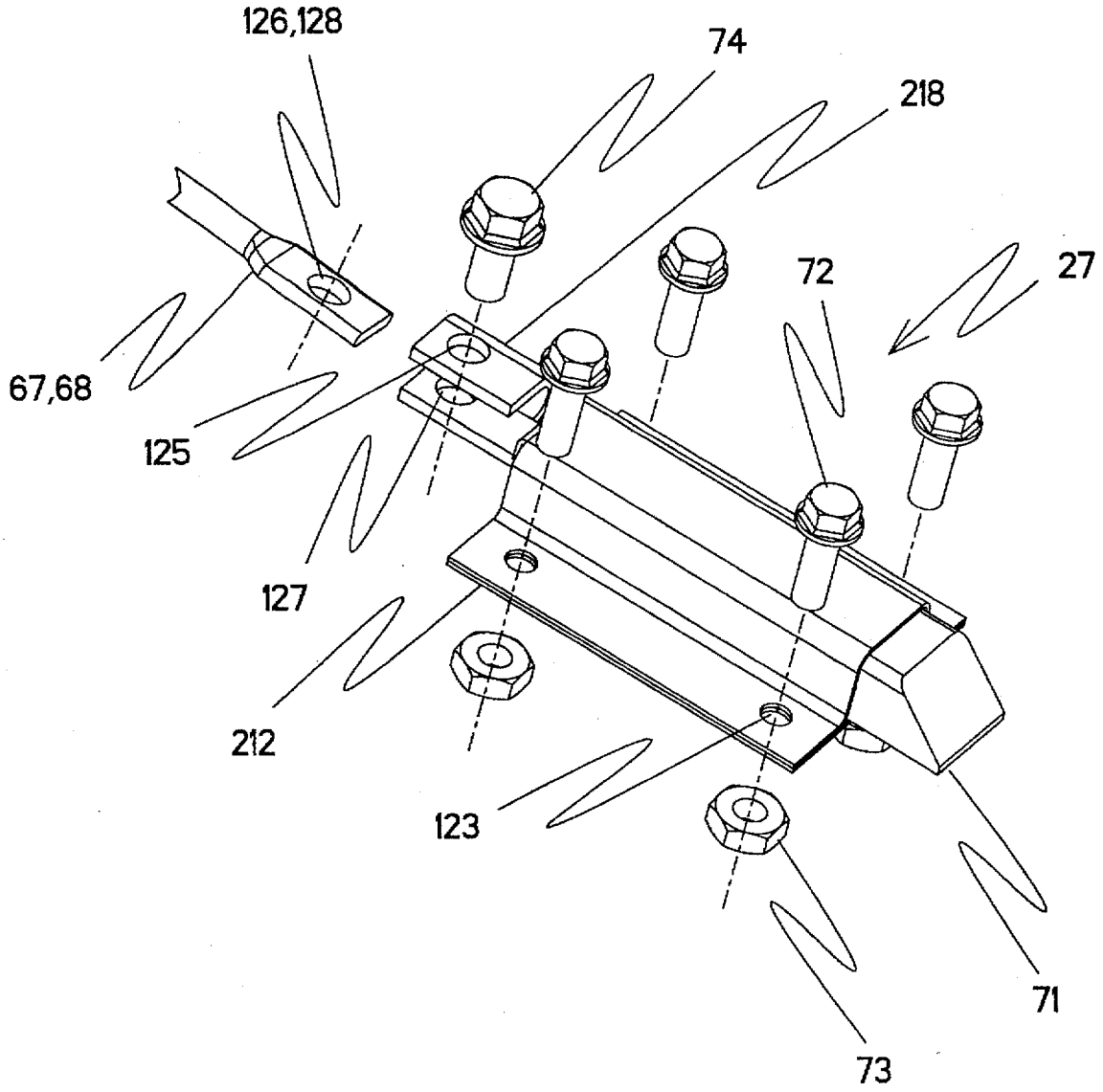
FIG. 13 is an exploded perspective view of the slide bolt assemblies of FIG. 11.

Referring now to FIG. 13, the slidably lock assembly 27 is shown. The bracket 212 is attached to the bar 21 via bolts/nuts 72, 73 which are placed through holes 123 so that the bolt 71 slides underneath bracket 212. A standard spring, not shown, can be included in the locking assembly 27 which will bias the bolt 71 in an outward position as shown. An upper fixture 218 is shaped to receive the flatten portion of the cable or rod portions 67, 68. The holes 125, 127 align with the holes 126, 128 on the rod portions and a screw or bolt 74 is used to secure fixture 218 to the rods 67, 68.

Figure 14:
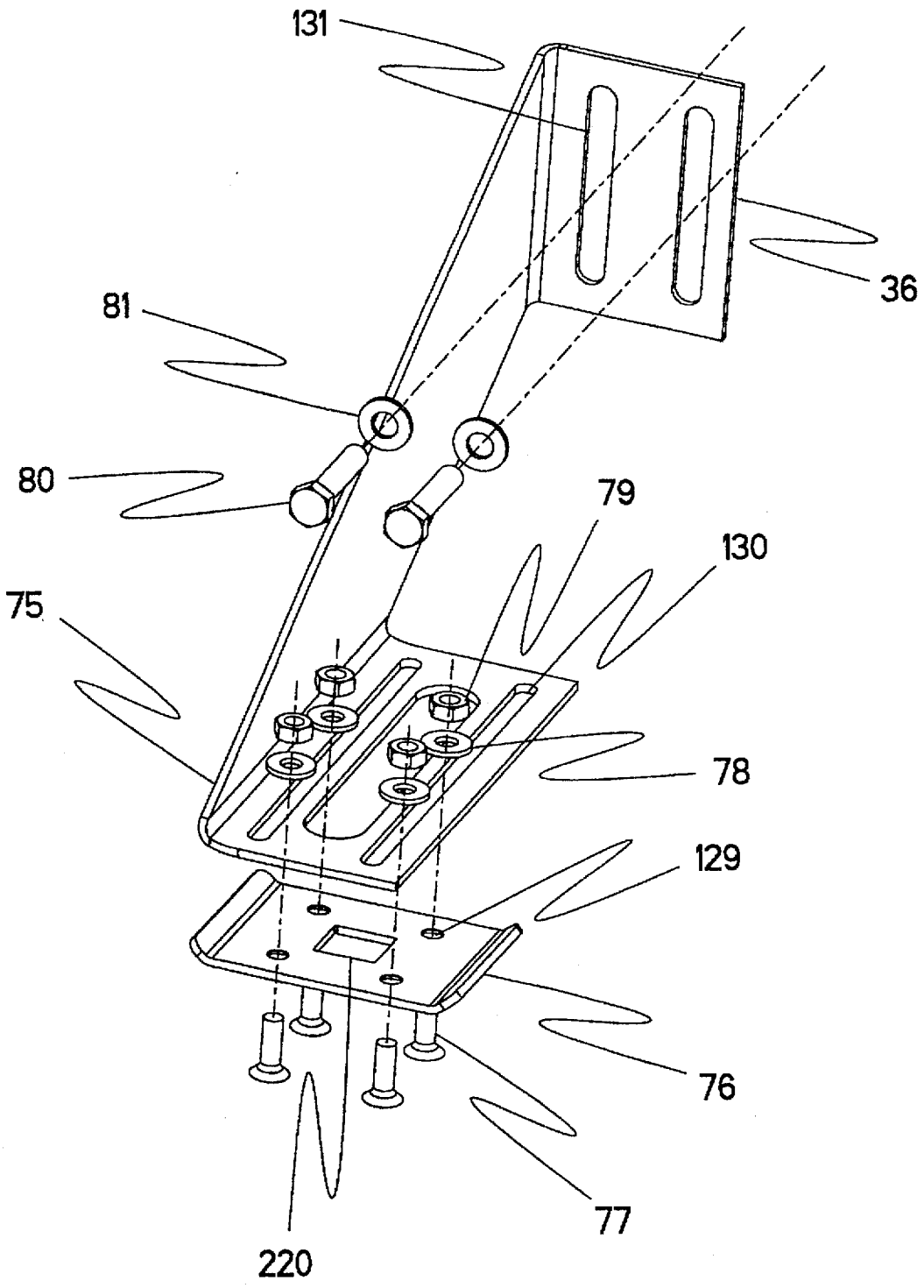
FIG. 14 is an exploded perspective view of the top slam assembly of FIG. 11.
Figure 15:
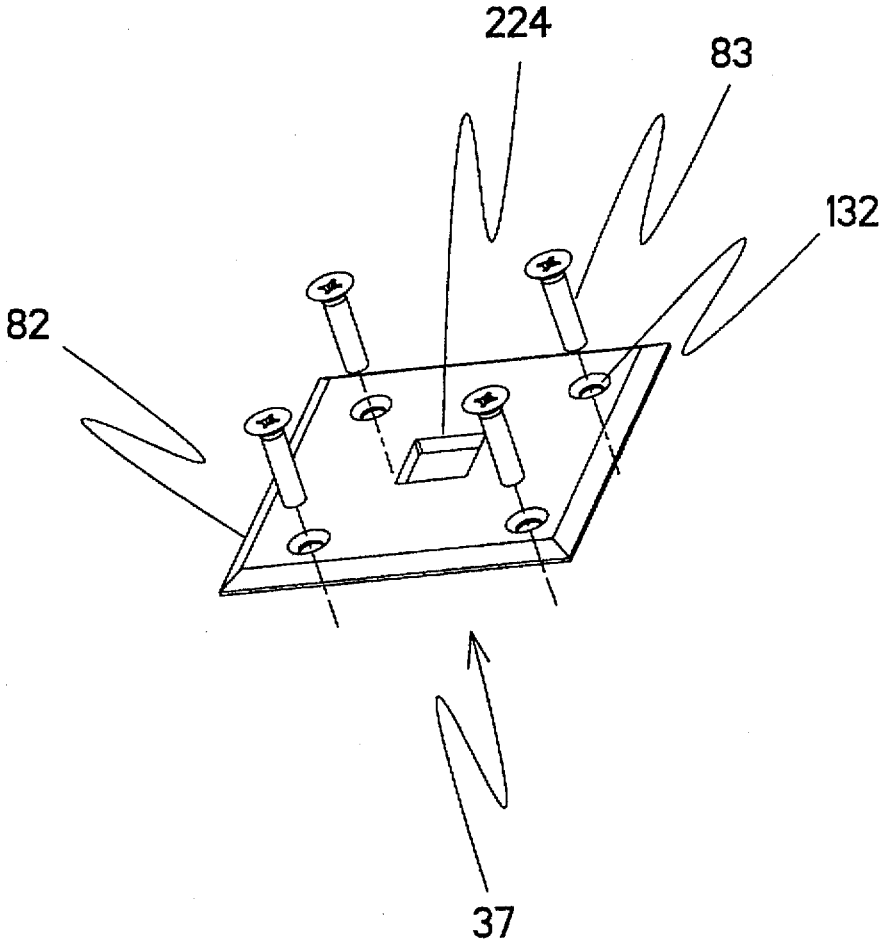
FIG. 15 is an exploded perspective view of the bottom slam assembly of FIG. 11.

Referring now to FIG. 14, the upper fixture 75 is shown. The back plate 36 is used to secure the fixture to the garage structure via bolt or screw combinations 80, 81 which are placed through elongated mounting slots 131 for adjustability. A plate 76 is adjustably mounted to the fixture 75 via bolt/washer/nut combinations 77, 78, and 79 which extend through holes 129 in the plate 76 and elongated slots 130 in the fixture 130. The slots 130 allow adjustment of the square-shaped aperture 220 along the central slot 222 on the fixture 75 for receiving the bolt 71 from the upper locking assembly 27. Referring now to FIG. 15, the lower fixture 37 is shown with a central square-shaped aperture 224 extending through the bracket 82 for receiving the bolt 71 from the lower locking assembly 27. The bracket 82 is mounted in the floor of a garage via screws or bolts 83 placed through mounting holes 132.

Figure 17:
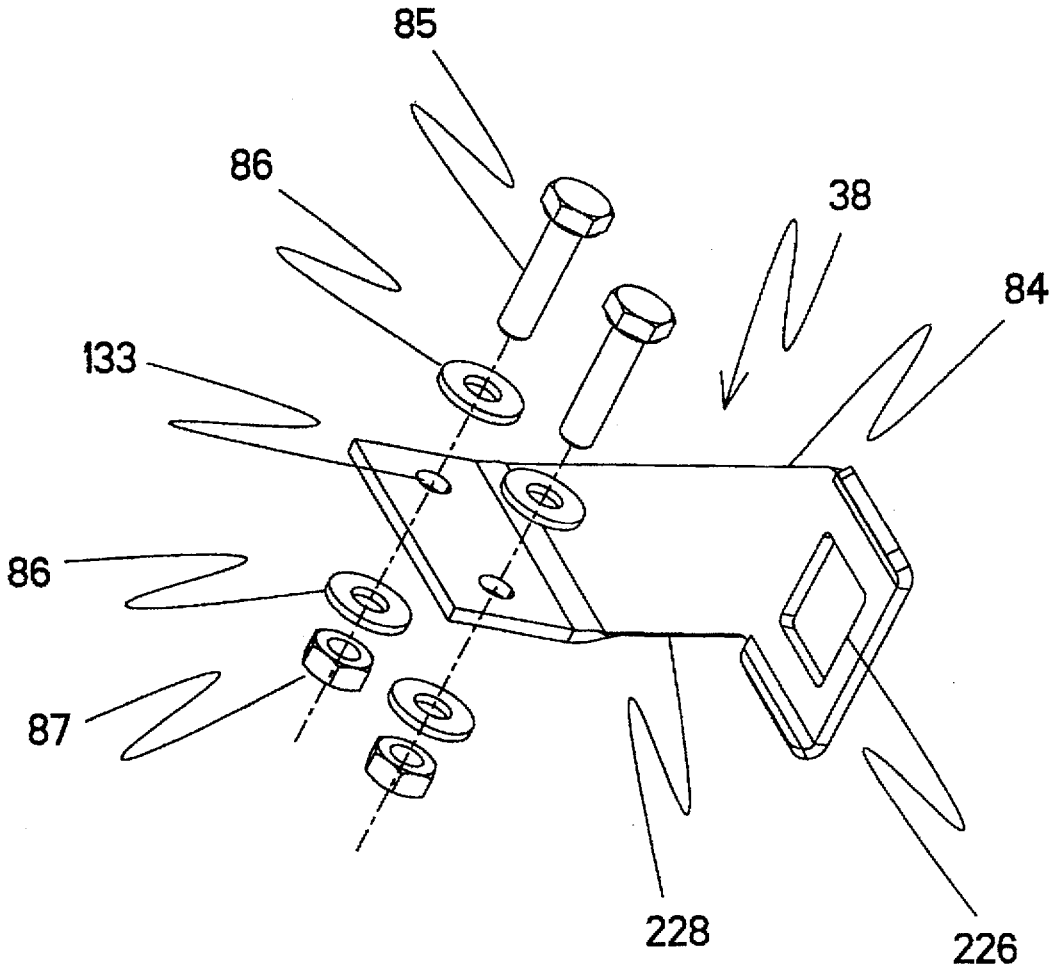
FIG. 17 is an exploded perspective view of the left slam assembly of FIG. 16.
Figure 18:
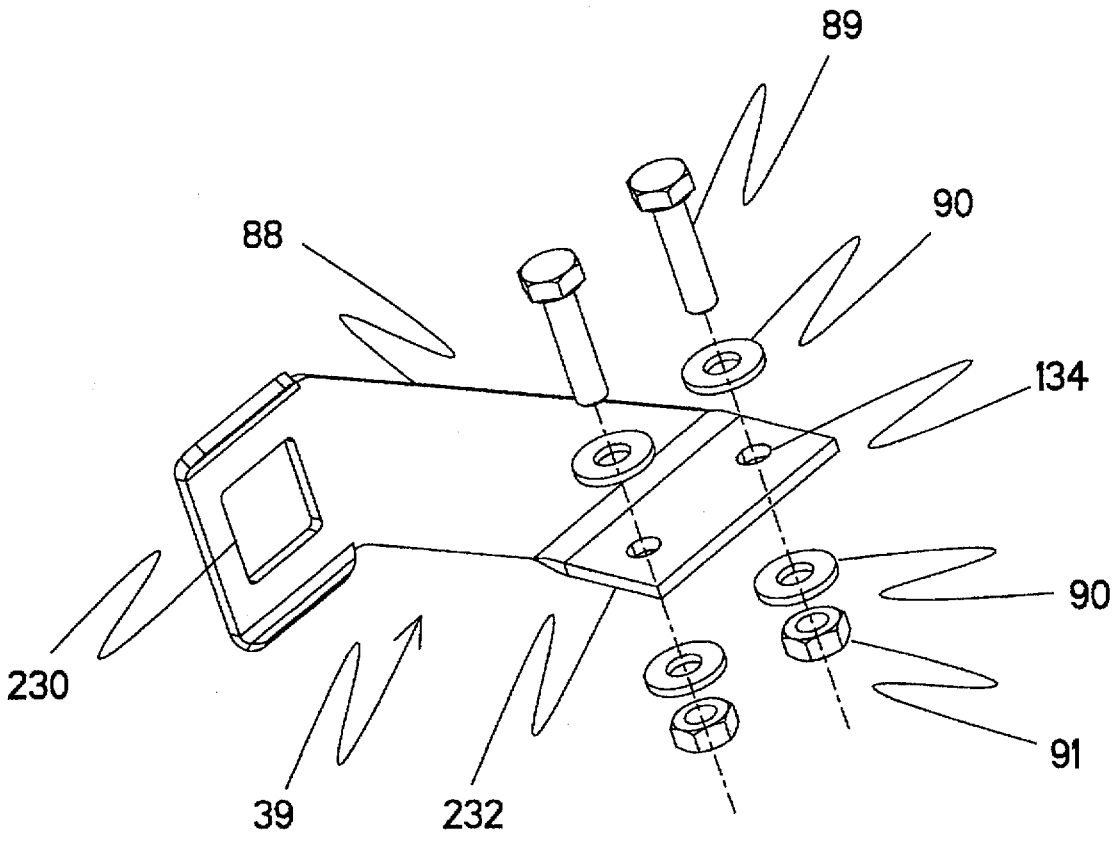
FIG. 18 is an exploded perspective view of the right slam assembly of FIG. 16.

Referring now to FIG. 17, the left bracing fixture assembly 38 is shown. The assembly 38 includes a bracket 84 with an aperture 226 extending outward from a mounting surface 228. The bracket 84 is mounted via through holes 133 and bolt/washer/nut combinations 85, 86, and 87 onto the cross brace 28, left of the pivot mount 23, 29. The lower latching assembly bolt 71 extends through the aperture 226 to secure the bar 21 to the garage door 20. Referring also to FIG. 18, the right bracing fixture assembly 39 is shown. The assembly 39 includes a bracket 88 with an aperture 230 extending outward from mounting surface 232. The bracket 88 is mounted via through holes 134 and bolt/washer/nut combinations 89, 90, and 91 onto the cross brace 28, right of the pivot mount 23, 29. The upper latching assembly bolt 71 extends through the aperture 226 to secure the bar 21 to the garage door 20. Together, the left and right brackets 84 and 88 hold the horizontally rotated bar securely against the garage door 20 in a stowed position, regardless of whether the garage door is up or down.

Referring to the Figures collectively, wind traveling in the direction of arrow 140 creates positive pressure against the garage door. The resultant load is resisted by: 1) the garage door hardware along the sides of the garage door and; 2) by contact post assembly 25 and each pin mount assembly 52 in the middle of horizontal span of the garage door. Wind traveling in a direction opposite to arrow 140 creates negative pressure against the garage door. The resultant load is resisted by: 1) the inside walls of the garage along the sides and top of the garage door and; 2) by each pin mount assembly 52 in the middle of the horizontal span of the garage door. Logically, the forces and moments exerted on the door hardware are proportionally decreased by the engagement of support assembly 10. Therefore, the garage door is capable of sustaining a proportionally higher wind load without collapse.

When the high wind load is no longer present, release lever assembly 24 is actuated, which in turn retracts both lock assemblies 27. Support assembly 10 is then pivoted by hand ninety degrees counter-clockwise about pivot bolt 30 to a horizontal position. As support assembly bar 21 approaches the horizontal position, the top lock assembly 27 engages left bracket assembly 38 and the bottom lock assembly 27 engages right bracket assembly 39. Support assembly bar 21 is now in the passive position and the garage door can be opened and closed normally.

Summary, Ramifications, and Scope

Accordingly, the reader will see that this invention has the following advantages:

- it provides a garage door support that buttresses the garage door against wind loads;
- it provides a garage door support that effectively halves the horizontal garage door span and provides a proportionate increase in wind load capability;
- it provides a garage door support that can be attached to a variety of different garage doors;
- it provides a garage door support that can be installed and removed from the door without permanently damaging the door;
- it provides a garage door support that remains on the door in a passive position when not in use;
- it provides a garage door support that can be hand-engaged by the homeowner;

it provides a garage door support constructed of lightweight materials;

it provides a garage door support constructed of inexpensive materials using inexpensive manufacturing techniques allowing for a very low retail price;

it provides a garage door support whose attachment to the garage door is accomplished through a pivot mount;

Although the description above contains many specificities, these should not be construed as limiting the scope of the invention but as merely providing illustrations of some of the presently preferred embodiments of this invention. For example, the support assembly might be altered with respect to its dimensions and materials and still be within the scope of this invention. Having thus fully described my invention, modifications may occur to those skilled in art which modifications are intended to be included within the scope of this invention.

In the embodiment of the invention that has been shown and described, the garage door 20 is comprised of a plurality of door sections. It is within the scope of this invention that the garage door may be constructed of a single member. Cross braces 28, 32, and 33 can easily be attached to a single piece door. Various types of members might be used, such as rectangular wood studs, and still fall within the scope of the inventor's application. It should also be apparent to those skilled in the art that the invention can be scaled to fit any building aperture cover, such as a door or window shutters, and still fall within the scope of this invention. The preferred embodiment utilizes various brackets that are formed sheet metal. It should be obvious to those skilled in the art that these brackets can assume various shapes and can be made from various materials and still fall within the scope of this invention. Various types of pivoting mechanisms, with respect to door pivot assembly 29 and support pivot assembly 23, can be utilized and still fall within the scope of this invention. Various types of lever cam mechanisms, with respect to release lever assembly 24, can be utilized and still fall within the scope of this invention. Various types of auxiliary attachments, with respect to door catch assembly 34 and pin mount assembly 26, can be utilized and still fall within the scope of this invention. All machine screws, nuts, washers, and spacers may be virtually any suitable fastener that, under wind loads, securely attaches the support to the building aperture cover and to the building. Simple machine screws and nuts are economical and quite useful for this purpose.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

I claim:

1. A support assembly for bracing an aperture covering of a building structure, the support assembly comprising:

a plurality of cross braces adapted to be mounted on the inside surfaces of said aperture covering;

a support bar;

a pivot mount assembly whereby said support bar is pivotally mounted to said inside surface of said aperture covering and wherein said support bar is pivotable to a vertical support position and a horizontal stored position.;

an upper and lower locking assembly, each assembly having a slidable locking bolt controlled by a handle assembly;

an upper fixture for lockably engaging said slidable locking bolt of said upper locking assembly, and a lower fixture for lockably engaging said slidable locking bolt of said lower locking assembly, when said support bar is pivoted to said vertical support position; and a first bracket for lockably engaging said slidable locking bolt of said upper locking assembly, and a second bracket for lockably engaging said slidable locking bolt of said lower locking assembly, when said support bar is pivoted to said horizontal stored position.

2. The support assembly of claim 1, wherein a plurality of support pin assemblies are adjustably mounted on said support bar and a corresponding plurality of receiving aperture assemblies are mounted on said cross braces, said pin assemblies engaging said corresponding receiving assemblies when said support bar is rotated into said vertical support position.

3. The support assembly of claim 1, wherein said handle assembly includes a release handle pivotally mounted to said support bar which is used to slidably retract said locking assemblies simultaneously.

4. The support assembly of claim 1, wherein said support bar is a metallic C-shaped beam.

5. The support assembly of claim 1 wherein said handle assembly includes a release handle which pivots and engages a cable which is attached at either end to said upper and lower locking assemblies, said cable being twisted by said pivoting release handle to thereby retract said locking assemblies.

6. The support assembly of claim 1, wherein said handle assembly includes a pivoting release handle with a first and second oppositely mounted lever arm, said first lever arm connected to a rod attached to said upper locking assembly, said second lever arm connected to a rod attached to said lower locking assembly.

7. The support assembly of claim 1, wherein said pivot mount includes a first mounting bracket with a bolt aperture attached to one of said cross braces and a second mounting bracket with a bolt aperture attached to said support bar, wherein a bolt assembly pivotally connects said first and second mounting bracket.

8. The support assembly of claim 1, wherein each said locking assembly includes a spring which biases said locking bolt outward and provides resistance against slidable retraction of said locking bolt.

* * * * *